US005350005A

United States Patent [19]

Sorimachi et al.

[11] Patent Number: 5,350,005

[45] Date of Patent: Sep. 27, 1994

[54] CONTROL DEVICE FOR CONTROLLING MOLD OSCILLATION IN A CONTINUOUS CASTING MACHINE

[75] Inventors: Kenichi Sorimachi, Chiba; Hirokazu Tozawa, Okayama; Toshiaki Ochi; Yasuhito Itoh, both of Ehima, all of Japan

[73] Assignees: Kawasaki Steel Corporation, Kobe; Sumitomo Heavy Industries, Ltd., Tokyo, both of Japan

[21] Appl. No.: 64,436

[22] Filed: May 21, 1993

[30] Foreign Application Priority Data

May 21, 1992 [JP] Japan ..... 4-128502

[51] Int. Cl.[5] ..... B22D 11/04; B22D 11/07

[52] U.S. Cl. ..... 164/154.1; 164/416; 164/268

[58] Field of Search ..... 164/154, 416, 268, 478, 164/472, 452

[56] References Cited

U.S. PATENT DOCUMENTS 4,762,164 8/1988 Grove ..... 164/150

FOREIGN PATENT DOCUMENTS 0121622 10/1984 European Pat. Off. .
0124362 11/1984 European Pat. Off. .
0325931A1 8/1989 European Pat. Off. .
0372506A2 6/1990 European Pat. Off. .
3632333A1 3/2988 Fed. Rep. of Germany .
3-99756 4/1991 Japan ..... 164/416

*Primary Examiner*—Kuang Y. Lin
*Attorney, Agent, or Firm*—Burns, Doane, Swecker & Mathis

[57] ABSTRACT

A control device for controlling mold oscillation in a continuous casting machine comprises a horizontal position detector, an open-close control device and hydraulic cylinders. The horizontal position detector is attached to a piston rod of the hydraulic cylinder for detecting an actual position of long-side copper plates of a mold. The open-close control device further comprises a reference position compensation circuit where a predetermined offset value is received. The reference position compensation circuit produces a compensation signal with which a target position of the long-side copper plates is modified. The open-close control device controls the hydraulic cylinders according to the compensation signal such that a deviation between the actual horizontal position and the target horizontal position of the long-side copper plates becomes equal to the offset value.

7 Claims, 8 Drawing Sheets

CONTROL DEVICE FOR CONTROLLING MOLD OSCILLATION IN A CONTINUOUS CASTING MACHINE

BACKGROUND OF THE INVENTION

This invention relates to a control device for controlling oscillation on a mold in a continuous casting machine.

Continuous casting process has been used for manufacturing slabs or billets from molten metal. For this purpose, the molten metal is first poured into a mold. The molten metal is covered with powder (lubricant) being sifted on the surface thereof. The mold is then cooled to quench the molten metal, which in turn is further cooled at a guide roll assembly. The metal solidifies completely at the guide roll assembly and drawn through pinch rolls. The molten metal in the mold is moved downward along the inner surface thereof as the solid metal is drawn off the casting station. In this event, the powder contributes to inhibiting air oxidation of the metal and trapping inclusions on the metal surface. The powder lies between the mold and the molten metal, which improves lubrication of their interface. It also prevents the molten metal in the mold from being quenched excessively. The mold is shaken up and down repeatedly to reduce the damage on the inner surface of the mold caused by the direct contact with the metal. Though this vertical shaking is helpful for reducing the damage of the mold, it is not enough for effective inflow of the powder. Poor inflow of the powder badly affects the quality of end products and sometimes results in the sticking of the molten metal in the inner surface of the mold. This may cause a breakout of the mold as well as the molten loss hindering the effective casting of the metal.

To overcome the above mentioned problem, the present inventors have been developed a device for moving a mold while shaking the entire structure of the mold up and down. The mold comprises two long-side plates opposed to and in parallel with each other. The mold also comprises two short-side plates opposed to and in parallel with each other. The long-side and short-side plates construct the mold, which is surrounded by a rectangular mold frame with some distance away. As well known in the art, the long-side plates move closer to and away from each other in synchronism with the vertical movement of the mold. The long-side plates are in the most close relation when they contact with the short-side plates. When the long-side plates are extremely distant, there is the largest space between the mold and the molten metal. The problem of poor inflow of the powder can thus be solved by means of moving the long-side plates quickly.

The expansion and contraction of the short-side plates are, however, ignored in the above mentioned device. In other words, the short-side plates are regarded to be constant in width though they expand and contract over the temperature difference. The extent of expansion and contraction depends on heat transferred from the molten metal, which affects the distance between the long-side and the short-side plates. Expansion of the short-side plates results in the smaller distance between the long-side and short-side plates. This reduces the distance for moving the long-side plates and thus the space between the long-side plates and the molten metal. The smaller space can receive less powder, which badly affects the quality of end products. As mentioned above, poor inflow of the powder may be a cause of the sticking type, the breakout and the molten loss of the mold. On the contrary, contraction of the short-side plates increases the distance between the long-side and short-side plates. This may also cause the breakout due to the infiltration of the molten metal into the above mentioned gap.

As mentioned above, these plates should be held such that a suitable distance can be obtained between the long-side and short-side plates. For this purpose, a sensor can be used for sensing the thermal expansion of the short-side plates to adjust the distance between the long-side and short-side plates. The sensor of this type is useful only when the thermal expansion on each component is quite equal in the mold. Thus it is usually impossible to determine positively the thermal expansion on various components of the mold.

SUMMARY OF THE INVENTION

Accordingly, an object of the present invention is to provide a control device for controlling the horizontal oscillation of a mold in a continuous casting machine without being affected by the heat transferred from the molten metal.

On describing the gist of an aspect of this invention, it is understood that a control device controls the horizontal oscillation on a mold into which molten metal is poured in a continuous casting machine. The mold has a mold frame, two long-side plates opposed with each other, and two short-side plates extending orthogonal to the long-side plates. Each of the long-side plates is movably attached to the mold frame such that they can move horizontally through hydraulic cylinders and each of the hydraulic cylinders having a piston rod.

According to the above mentioned aspect of this invention, the control device comprises position detecting means attached to the piston rod for detecting an actual position of the long-side plates to produce an actual horizontal position signal representing the detected actual position of the long-side plates. Connected to the position detecting means, supplied with a target horizontal position command, and given to a predetermined offset value, open-close control means produces a control signal by using the target horizontal position command, the actual horizontal position signal, and the predetermined offset value. The target horizontal position command represents a target horizontal position of the long-side plates and the target horizontal position varies from a target close position up to a target open position indicated as a function of time. In this respect, the target close position can be considered as a reference position. The control signal indicates a deviation between the target horizontal position and the detected actual horizontal position. The open-close control means makes the deviation to be equal to the predetermined offset value when the target horizontal position is equal to the target close position. Connected to the open-close control means and the hydraulic cylinders, driving means drives the hydraulic cylinders according to the control signal.

These and other objects and features of the present invention will become more fully apparent from the following description and appended claims taken in conjunction with the accompanying drawing.

DESCRIPTION OF THE PREFERRED EMBODIMENT

Figure 1:
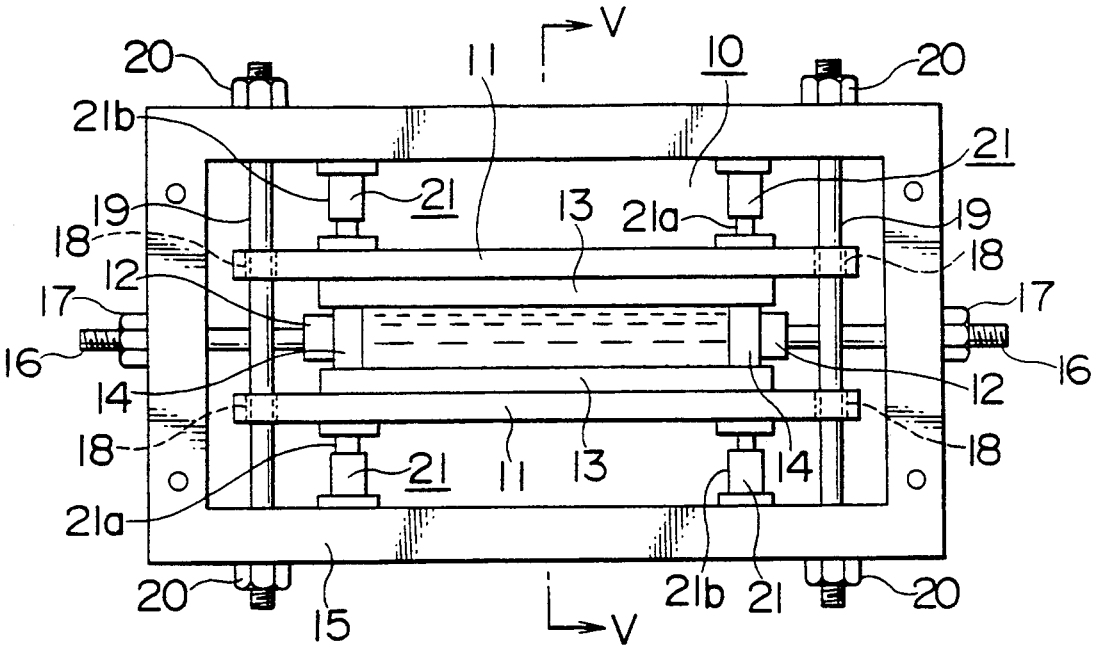
FIG. 1 PRIOR ART
FIG. 1 is a plan view of a conventional mold to which a control device according to the present invention is applicable.

A conventional mold with movable walls is described first to facilitate an understanding of the present invention. Throughout the following detailed description, similar reference numerals refer to similar elements in all figures of the drawing.

Figure 2:
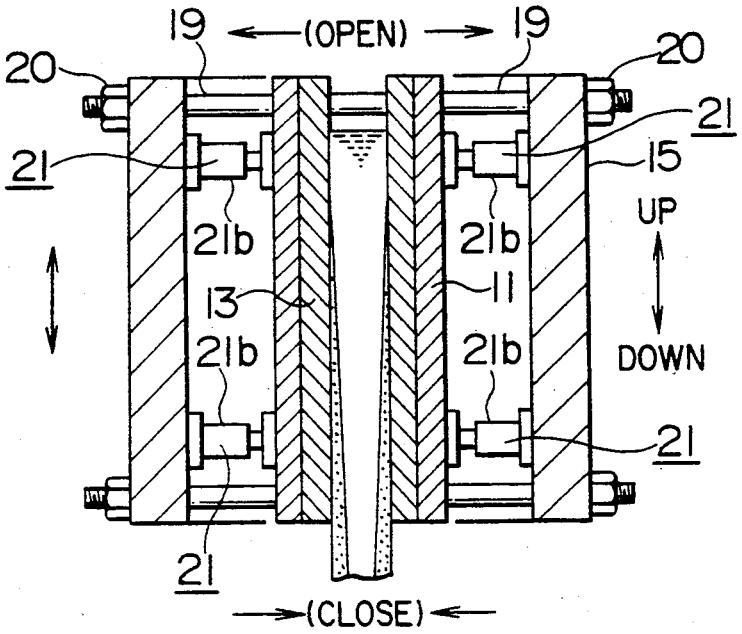
FIG. 2 PRIOR ART
FIG. 2 is a sectional view taken on line V—V in FIG. 1.

As shown in FIGS. 1 and 2, a shaded region indicates molten metal poured from ladle (not shown) through tundish (not shown). The molten metal is covered with powder being sifted on the surface thereof. A mold 10 comprises a pair of long-side framing members 11 and a pair of short-side framing members 12. The long-side framing members 11 are opposed to and in parallel with each other. The short-side framing members 12 are also opposed to and in parallel with each other. Each of the short-side framing members 12 extends in the orthogonal direction to the long-side framing members 11. The long-side framing members 11 hold long-side copper plates 13 on the inner surfaces thereof, respectively, in contact relation therewith. The short-side framing members 12 hold short-side copper plates 14 on the inner surfaces thereof, respectively, in contact relation therewith. Each of the short-side framing members 12 is supported by a mold frame 15 through an adjusting rod 16. The mold frame 15 is rectangular in cross-section and surrounds the long-side and short side framing members with some distance away. One end of the rod 16 is attached to the short-side framing member 12. The other end of the rod penetrating through the mold frame 15 has a suitable member such as a nut 17 to adjust the length of the rod 16 extending within the mold frame 15. As apparent from FIG. 1, the distance between the short-side framing members 12 can be varied by means of losing and tightening the nuts 17.

The long-side framing member 11 is larger in width than the long-side copper plate 13. Linear ball bearings 18 are disposed in four corners of the extending length of each framing member 11. The long-side framing members 11 are supported by the mold frame 15 through four guide rods 19 passing through the linear ball bearings 18. Both ends of the guide rod 19 are secured to the mold frame 15 through respective nuts 20, which allows the long-side framing members 11 to move in the direction closer to and away from each other. Four pairs of hydraulic cylinders 21 are provided within the mold frame 15, each of which comprises a piston rod **21*a* and a cylinder body 21*b*. The piston rod 21*a* is attached to the long-side framing member 11 near the linear ball bearing 18 while the cylinder body 21*b* is secured to the mold frame 15**.

The mold 10 is shaken up and down repeatedly in the direction indicated as "UP" and "DOWN" in FIG. 2. The long-side copper plates 13 move closer to and away from each other in synchronism with the vertical movement of the mold 10. In other words, the long-side copper plates 13 move in the direction indicated as "OPEN" and "CLOSE" in FIG. 2. The long-side plates 13 are in the most close relation when they contact with the short-side plates 14.

Figure 3:
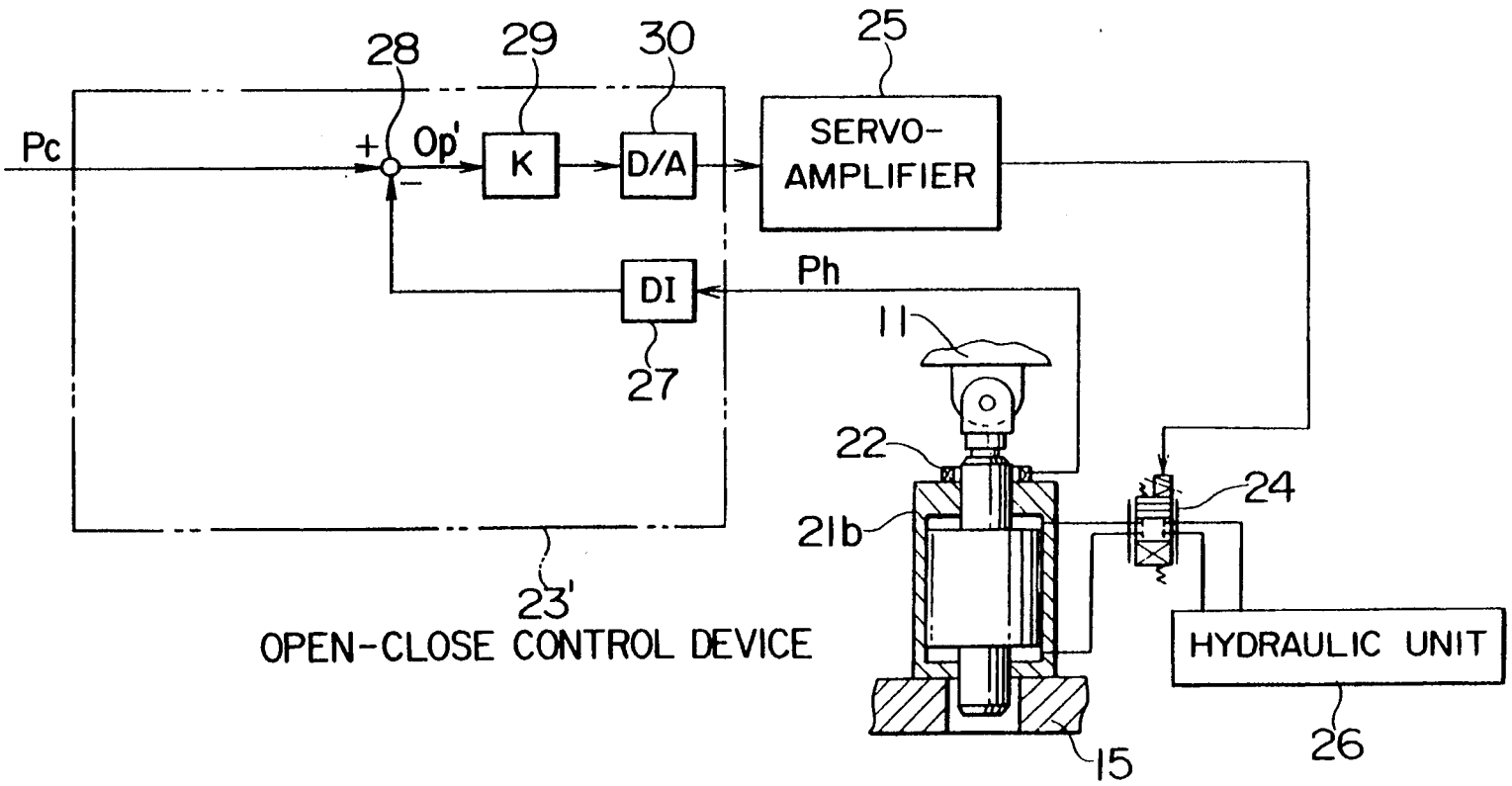
FIG. 3 PRIOR ART
FIG. 3 is a block diagram showing a conventional control device for controlling mold horizontal oscillation.

Turning to FIG. 3 in addition to FIGS. 1 and 2, a conventional control device is described in detail below. While only one control device is shown in FIG. 3, it should be understood that each of the eight hydraulic cylinders is associated with a similar control device. A horizontal position detector 22 is attached to the cylinder body **21*b* to determine an actual position of the long-side copper plate 13. In this event, the horizontal position detector 22 first detects a shift amount of the piston rod 21*a* and according to which it determines the position of the long-side copper plate 13. The horizontal position detector 22 produces an actual horizontal position signal Ph that represents the actual horizontal position of the long-side copper plate 13. The actual horizontal position signal Ph is supplied to an open-close control device 23' that is for moving the long-side copper plates 13 into relatively open and close positions. The open-close control device 23' is connected to a microcomputer (not shown) that produces a target horizontal position command Pc. The target horizontal position command Pc indicates a target horizontal position of the long-side copper plate 13 at every moment. In other words, the target horizontal position command Pc indicates an instantaneous position to which the long-side copper plate 13 should follow. The microcomputer is set various data indicating, e.g., the timing at which it begins to open or close the long-side copper plates 13 and target open and close positions thereof. In this event, the timing is determined relating to the vertical position of the mold 10. By means of this, the long-side copper plates 13 can move horizontally in synchronism with the vertical movement of the mold 10** in a conventional manner.

The open-close control device 23' receives the target horizontal position command Pc generated by the microcomputer and supplies an analog control signal to a servo-valve 24 through a servo-amplifier 25 such that the actual horizontal position of the long-side copper plate 12 comes up to the target horizontal position indicated by the target horizontal position command Pc. The servo-valve 24 is connected to a hydraulic unit 26 that will be described below. A combination of the servo-valve 24, the servo-amplifier 25 and the hydraulic unit 26 serves as a driving arrangement for driving the hydraulic cylinders 21. As shown in FIG. 3, the open-close control device 23' comprises a digital input device (DI) 27, a subtractor 28, an amplifier (regulator) 29, and a digital/analog converter (D/A) 30. The digital input device 27 receives the actual horizontal position signal Ph as a digital input. The subtractor 28 subtracts the actual horizontal position signal Ph from the target horizontal position command Pc to produce an operational (or actuating) signal Op' representing a deviation between the actual and target positions of the long-side copper plate 13. The amplifier 29 acts as an adjusting unit for multiplying the operational signal Op' by a gain constant K to produce a digital control signal. The digital/analog converter 30 converts the digital control signal into the aforementioned analog control signal.

The target horizontal position of the long-side copper plate 13 ranges from a target open position to a target close position as a function of time. The target open and close positions are fixed, which the latter generally corresponds to the position where the long-side copper plate 13 contacts the short-side copper plate 14. In other words, the target horizontal position of the long-side copper plate 13 is determined relating to the contact position between the long-side and short-side copper plates. Accordingly each long-side copper plate 13 is expected to move horizontally between the target open position and the target close position. The movement of the long-side copper plate 13 causes the change of distance between the long-side copper plate 13 and the short-side copper plate 14. The maximum open distance obtained under control of the open-close control device is referred as an actual span distance. The actual span distance corresponds to the distance between the actual open position of the long-side copper plate 13 and the actual position of the short-side copper plate 14 hence the use of term actual open position. In addition, what is referred to as a target span position is the distance between the target open position and the target close position.

The expansion and contraction of the short-side copper plates 14 are not considered in the above mentioned control device 23'. In other words, the short-side copper plates 14 are regarded to be constant in width though they expand and contract over the temperature difference. The extent of expansion and contraction of the short-side copper plates 14 depends on heat transferred from the molten metal, which affects the actual span distance.

Figure 4:
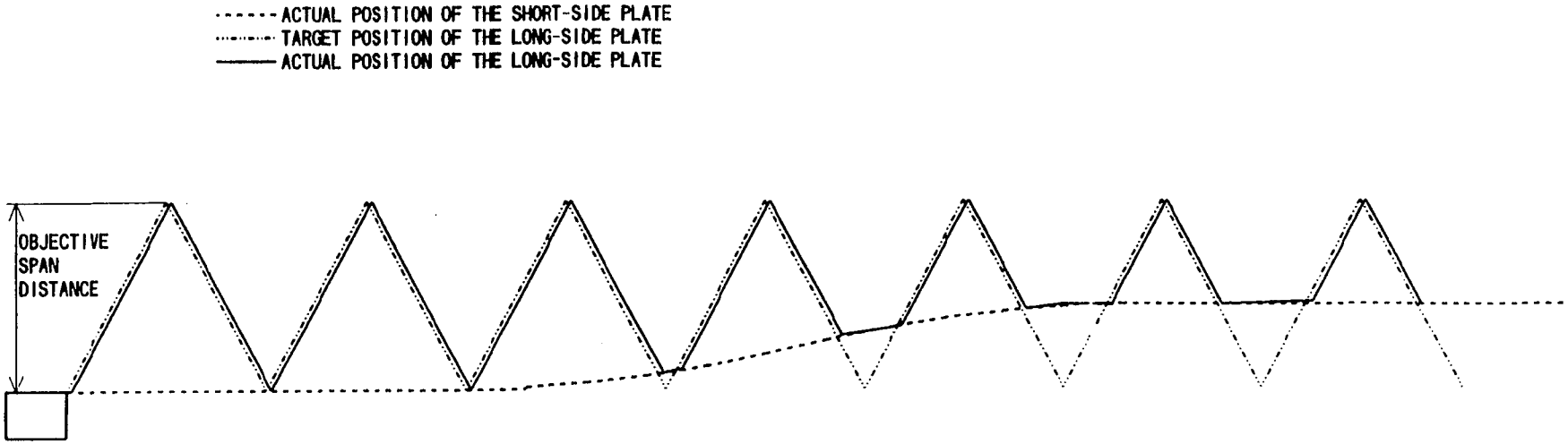
FIG. 4 PRIOR ART
FIG. 4 is a graphical representation showing, as a function of time, relation among target and actual positions of a long-side copper plate and an actual position of an expanded short-side copper plate when a conventional open-close control device is used.
Figure 5:
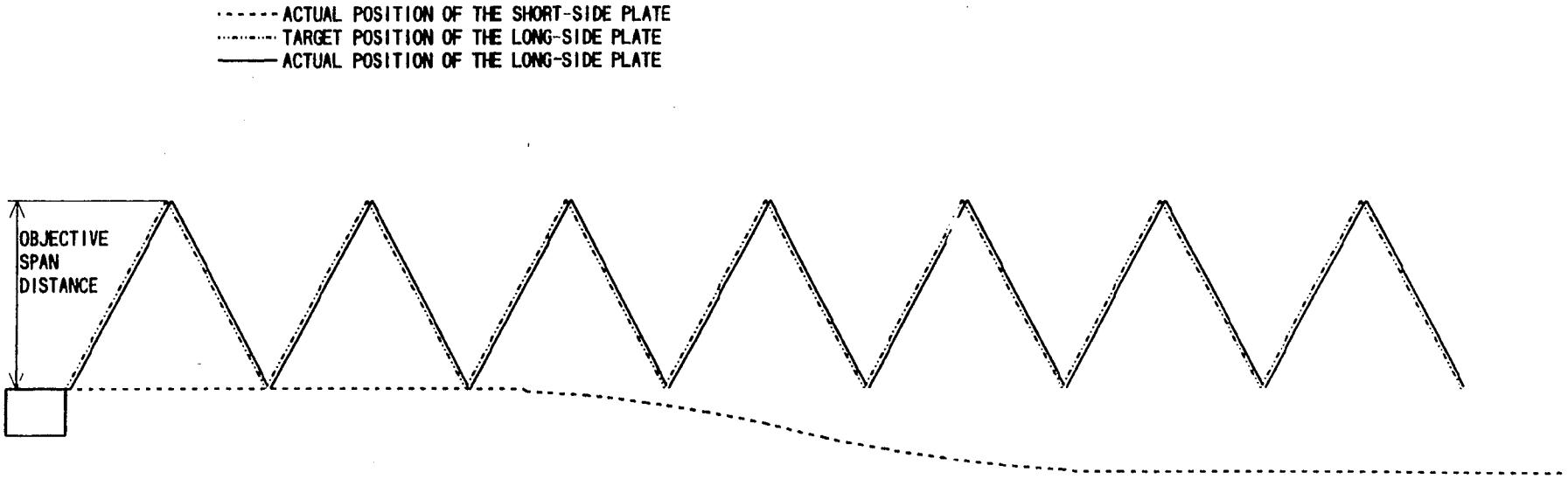
FIG. 5 PRIOR ART
FIG. 5 is a graphical representation showing, as a function of time, relation among target and actual positions of a long-side copper plate and an actual position of a contracted short-side copper plate when a conventional open-close control device is used.

FIG. 4 is a graphical representation showing, as a function of time, relation among target and actual positions of a long-side copper plate and an actual position of an expanded short-side copper plate when a conventional open-close control device is used. FIG. 5 is a graphical representation showing, as a function of time, relation among target and actual positions of a long-side copper plate and an actual position of a contracted short-side copper plate when a conventional open-close control device is used. In these figures, a broken curve represents an actual position of the short-side copper plate 14. A triangular waveform of the broken dot line represents the target horizontal position of the long-side copper plate 13. A solid triangular waveform represents the actual position of the long-side copper plate 13. It is noted that the term "actual position of the short-side copper plate" corresponds to the position of the transversal side of the plate 14 facing to the long-side copper plate 13. The target span distance corresponds to the distance between the upper and lower apexes of the triangle (broken dot line), i.e., the distance between the peak and valley. The distance between the top of the triangle (solid line) and the actual position of the short-side copper plate corresponds to the actual span distance.

The actual horizontal position should follow the target horizontal position indicated by the target horizontal position command Pc. In this event, the long-side copper plate 13 can move horizontally only as much as the space defined to the short-side copper plate 14. In FIG. 4, the expansion of the short-side copper plate 14 results in reduction of the actual span distance. This is shown where the solid line overlays the broken curve. The actual span distance becomes shorter as the short-side copper plate 14 expands. As a result, the smaller space is available for the long-side copper plate 13 to travel, causing reduction of the space between the interfaces of the long-side copper plate 13 and the molten metal. The smaller space can receive less powder, which badly affects the quality of end products. Poor inflow of the powder may be a cause of the sticking type, the breakout and the molten loss of the mold. In FIG. 5, contraction of the short-side copper plate 14 increases the actual span distance. The long-side copper plate 13 positively follows the target horizontal position though the actual span distance is increased due to the contraction of the short-side copper plate 14. As a result, the larger space is available between the interfaces of the long-side copper plate 13 and the molten metal. The larger space can receive unnecessary much powder or sometimes cause the breakout due to infiltration of the molten metal into the above space. The conventional device is thus disadvantageous in that it takes no expansion and contraction of the short-side copper plates 14 into account as mentioned in the preamble of the instant specification.

An embodiment of the present invention is now described with reference to FIGS. 6 through 9.

Figure 6:
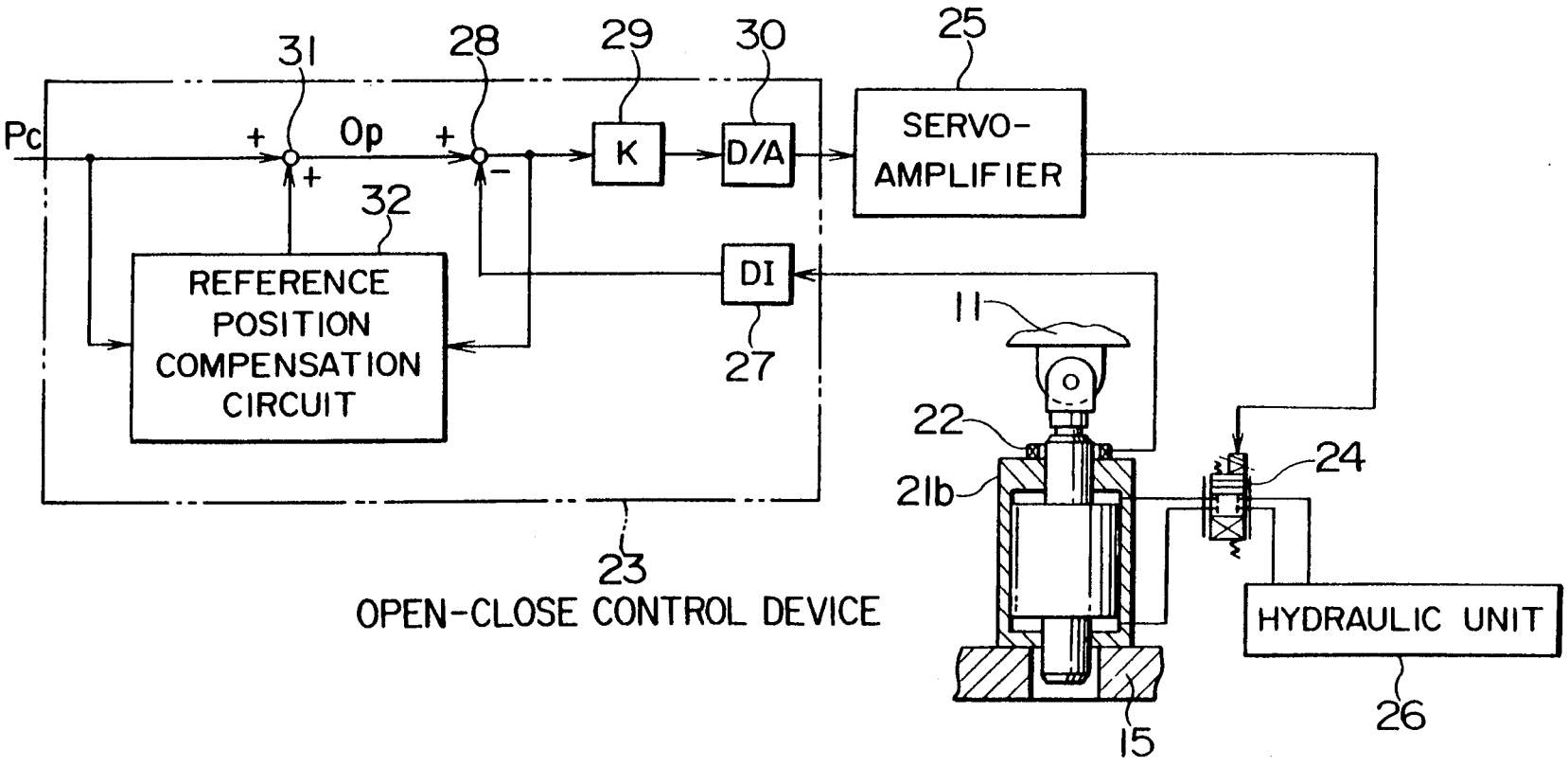
FIG. 6 is a block diagram showing a control device for controlling mold horizontal oscillation according to the present invention.

FIG. 6 is a block diagram showing a control device for controlling mold horizontal oscillation according to an embodiment of the present invention. An open-close control device 23 in FIG. 6 is similar in structure and operation to the control device 23 illustrated in FIG. 3 other than an adder 31 and a reference position compensation circuit 32. Description of the similar components will thus be omitted by the consideration of avoiding redundancy. The adder 31 adds a compensation signal (described below) to the target horizontal position command Pc to produce a modified target position command. The compensation signal is for compensating the actual span distance varied as a result of the expansion and the contraction of the short-side copper plate 14. The modified target position command represents the modified target position of the long-side copper plate 13 and is supplied to the subtractor 28. The subtractor 28 subtracts the actual horizontal position signal Ph from the modified target position command to produce an operational (or an actuating) signal Op. The operational signal Op indicates a deviation between the actual horizontal position and the modified target position of the long-side copper plate 13 rather than the deviation relating to the target horizontal position thereof. The subtractor 28 supplies the operational signal Op to the reference position compensation circuit 32 as well as the amplifier 29. A combination of the adder 31 and the reference position compensation circuit 32 serves as a target position modifying arrangement for modifying the target horizontal position into a modified target position.

Figure 7:
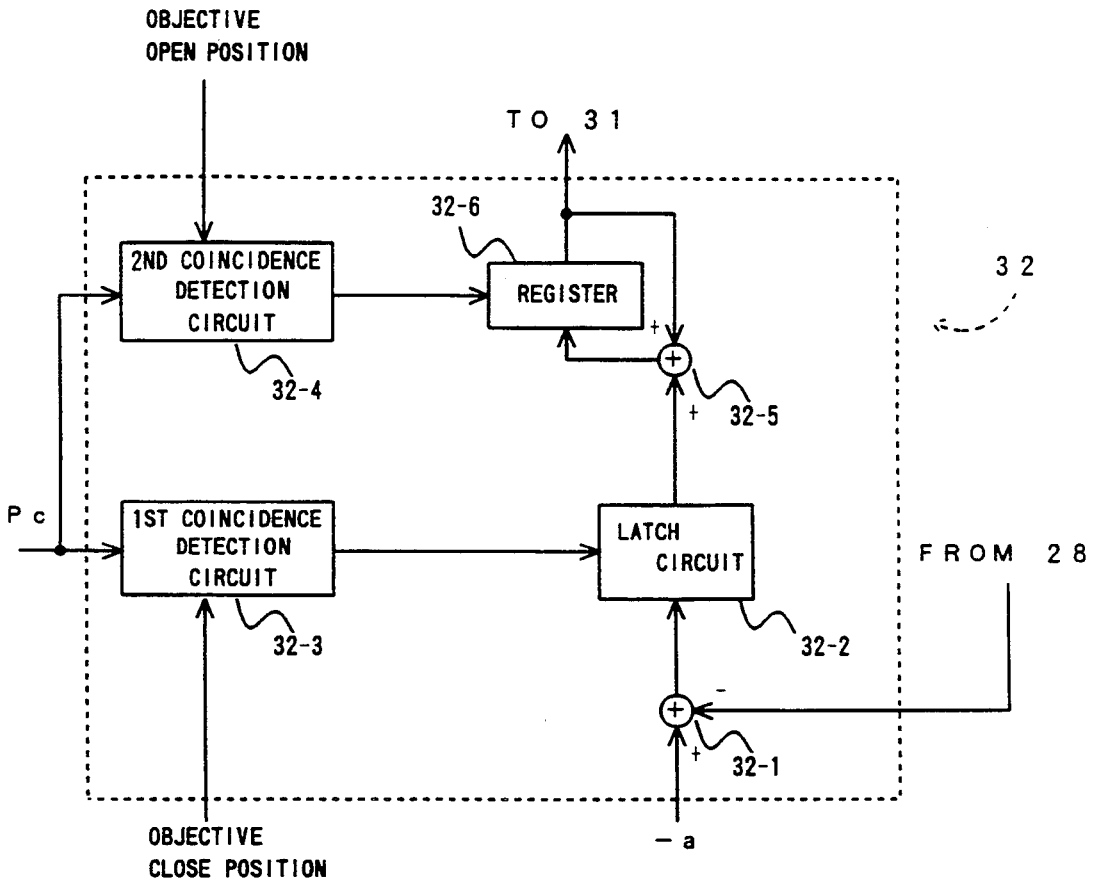
FIG. 7 is a block diagram showing a reference position compensation circuit in the device illustrated in FIG. 6.

Turning to FIG. 7 in addition to FIG. 6, the reference position compensation circuit 32 is shown which comprises a subtractor 32-1, a latch circuit 32-2, a first coincidence detection circuit 32-3, a second coincidence detection circuit 32-4, an adder 32-5 and a register 32-6. A predetermined offset value "−a" (minus a)" is given to the subtractor 32-1. The subtractor 32-1 also receives the operational signal Op supplied from the subtractor 28. The subtractor 32-1 subtracts the operational signal Op from the predetermined offset value "−a" to supply the subtraction result to the latch circuit 32-2 as a shift signal. The shift signal corresponds to a shift amount of a target open position from the previous target open position. The latch circuit 32-2 latches the shift signal for a predetermined time interval. The first coincidence detection circuit 32-3 is supplied with the target horizontal position command Pc and a signal indicative of the target close position from the microcomputer (not shown). The first coincidence detection circuit 32-3 produces a first coincidence detection signal when the target horizontal position comes up to the target close position. In response to the first coincidence detection signal, the latch circuit 32-2 latches the shift signal as a latched signal that is supplied to the adder 32-5. The adder 32-5 adds the latched signal to an accumulated signal (described below) supplied from the register 32-6 to produce an addition signal. The register 32-6 supplies the accumulated signal as the compensation signal to the adder 31. The second coincidence detection circuit 32-4 is supplied with the target horizontal position command Pc and a signal indicative of the target open position from the microcomputer. It produces a second coincidence detection signal when the target horizontal position comes up to the target open position. In response to the second coincidence detection signal, the register 32-6 stores the addition signal as the stored signal to supply the same to the adder 32-5 as the accumulated signal. A combination of the subtractor 32-1, the latch circuit 32-2 and the first coincidence detection circuit 32-3 acts as a comparing arrangement while that of the second coincidence detection circuit 32-4, the adder 32-5 and the register 32-6 serves as an accumulating arrangement.

Figure 8:
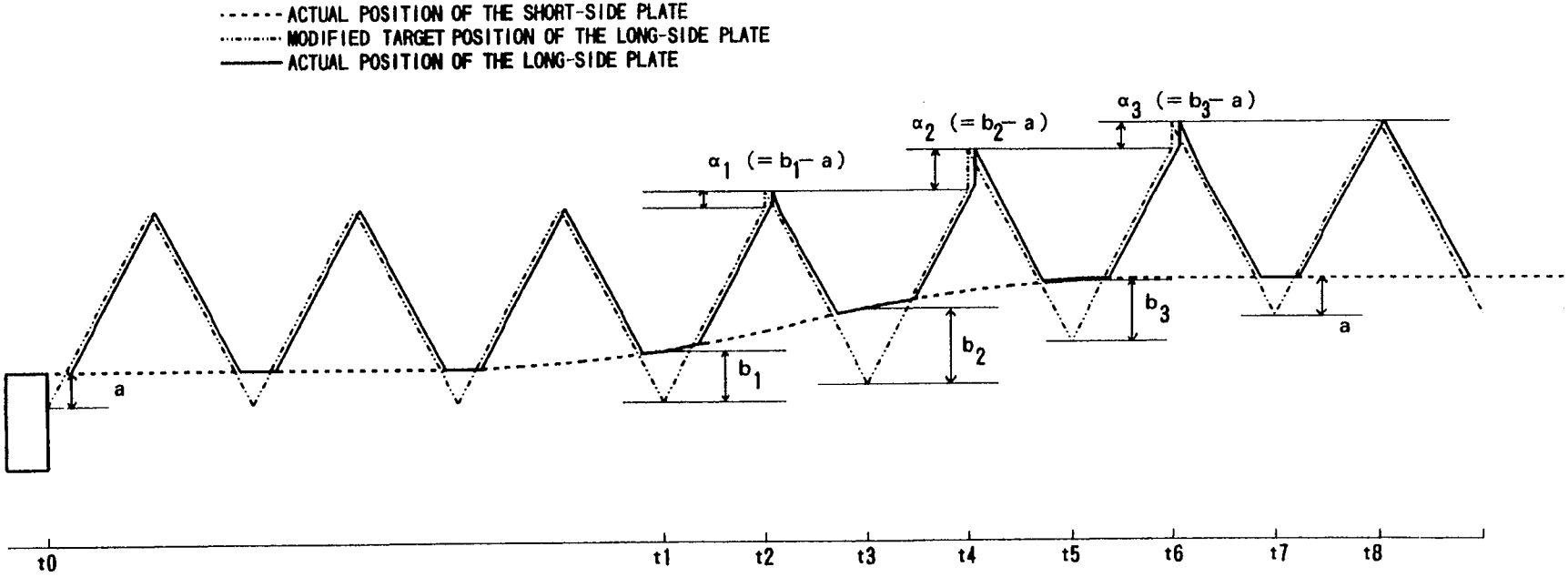
FIG. 8 is a graphical representation showing, as a function of time, relation among target and actual positions of a long-side copper plate and an actual position of an expanded short-side copper plate when an open-close control device of the present invention is used.
Figure 9:
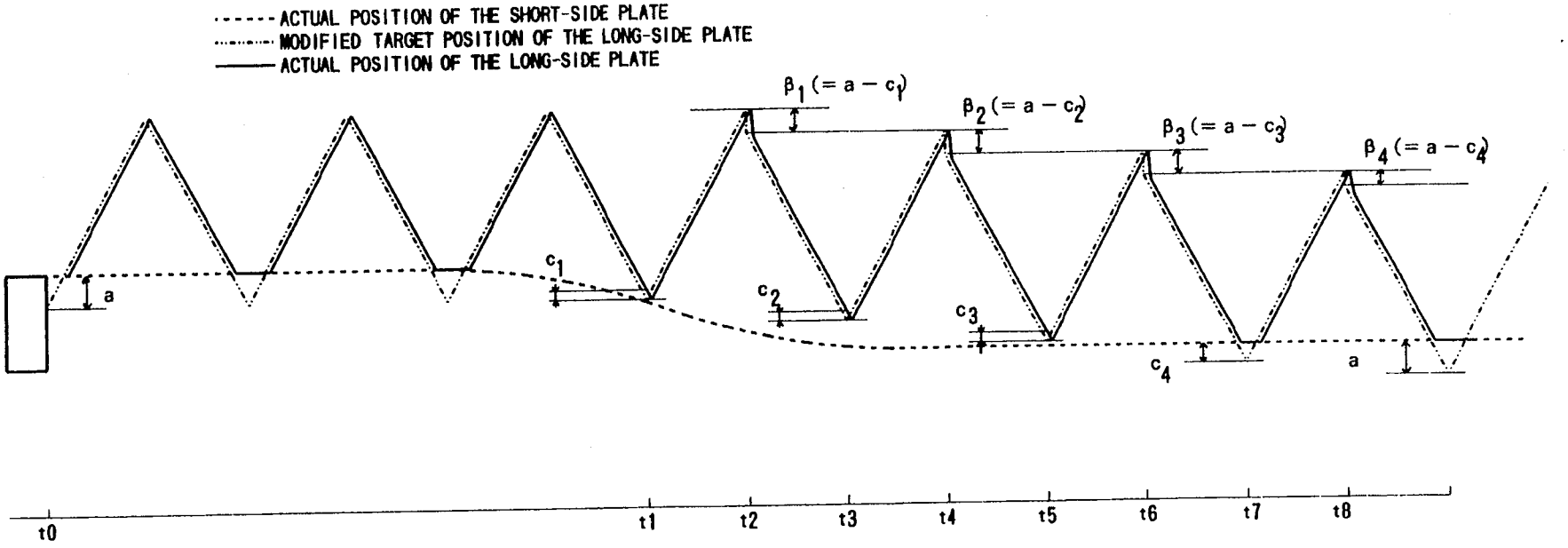
FIG. 9 is a graphical representation showing, as a function of time, relation among target and actual positions of a long-side copper plate and an actual position of an expanded short-side copper plate when an open-close control device of the present invention is used.

Referring to FIGS. 8 and 9, the open-close control device 23 is described more in detail so that the typical features of the present invention can be better appreciated. FIGS. 8 and 9 are view similar to FIGS. 4 and 5 except that the broken dot line represents a waveform for the modified target position of the long-side copper plate 13. The register 32-6 initially stores the offset value "−a" as the stored signal. The reference position compensation circuit initially produces the offset value "−a" as the compensation signal. Thus the modified target position of the long-side copper plate 13 is initially defined inside the target close position. In other word, the modified target position is shifted backward the target close position by an amount "a" relating to the open direction of the long-side copper plates. This is clearly shown in FIGS. 8 and 9. In these figures the offset is indicated as "a" rather than "−a" at a time instance $t_0$, this is attributed only to that a difference between two points can be represented only as a positive value. Accordingly it should be considered that the offset value supplied to the subtractor 32-1 (FIG. 7) has a negative value, i.e., "−a" in this embodiment. Of course, as apparent from the trail of the solid line, the distance between two long-side copper plates 13 will never be shorter than the width of the short-side copper plates 14.

In FIG. 8, a distance "$b_1$" represents a difference between the actual close position and the modified target close position at a time instance $t_1$. The operational signal Op represents the deviation "$-b_1$" because the operational signal Op is obtained by subtracting the actual position from the target position. The shift signal supplied from the subtractor 32-1 thus represents "$-a-(-b_1)$" or "$b_1-a$". This value of the shift signal is represented as $a_1$ in FIG. 8. The time instance $t_1$ corresponds to the timing when the first coincidence detection circuit 32-3 detects that the target horizontal position comes up to the target close position. In response to the first coincidence detection signal, the latch circuit 32-2 latches the shift signal $a_1$ as the latched signal that is supplied to the adder 32-5. The adder adds the latched signal $a_1$ to the accumulated signal. Inasmuch as the register 32-6 stores the accumulated signal that represents "−a" at that moment, it is supplied with the addition signal indicative of "$-a+\alpha_1$". When the target horizontal position coincides with the target open position, the second coincidence detection circuit produces the second coincidence detection signal. This corresponds to a time instance $t_2$ in FIG. 8. In response to the second coincidence detection signal, the register 32-6 stores the compensation signal "$-a+\alpha_1$" as the accumulated signal which, in turn, is supplied to the adder 31 as the compensation signal. It is noted that the adder 31 is supplied with the target horizontal position command Pc, so that the value of the compensation signal is obtained relating to the target close position (reference position) not being shifted. The modified target position is, however, shifted by "−a" beforehand. Accordingly, the modified target position is increased by $\alpha_1$.

The operational signal Op obtained at a time instance $t_3$ represents the deviation "$-b_2$". The shift signal supplied from the subtractor 32-1 thus represents "$-a-(-b_2)$" or "$b_2-a$". This value of the shift signal is represented as $\alpha_2$ in FIG. 8. In response to the first coincidence detection signal, the latch circuit 32-2 latches the shift signal $\alpha_2$ as the latched signal that is supplied to the adder 32-5. The adder 32-5 adds the latched signal $\alpha_2$ to the accumulated signal. More particularly, the compensation signal to be stored in the register is equal to "$-a+\alpha_1+\alpha_2$" because the accumulated signal at that moment represents "$-a+\alpha_1$". In response to the second coincidence detection signal, the compensation signal "$-a$"$+\alpha_1+\alpha_2$" is supplied from the register 32-6 at a time instance $t_4$ to the adder 31 and the modified target position is increased by $\alpha_2$. The shift signal supplied at a time instance $t_5$ represents "$-a-(-b_3)$" or "$b_3-a$". This value of the shift signal is represented as $\alpha_3$ and the compensation signal "$-a+\alpha_1+\alpha_2+\alpha_3$" is supplied from the register 32-6 at a time instance $t_6$ to the adder 31 and the modified target position is further increased by $\alpha_3$. This continues until the deviation between the modified target position and the actual position of the long-side copper plate 13 becomes equal. At a time instance $t_7$ the deviation becomes equal to the offset value, so that it is unnecessary to shift the modified target position at a time instance $t_8$.

In this way, it becomes possible to ensure the actual span distance despite the expansion of the short-side copper plate 14.

As shown in FIG. 9, the modified position shifts on contraction of the short-side copper plate 14. In FIG. 9, a distance "$C_1$" represents a difference between the actual close position and the modified target close position at a time instance $t_1$. The operational signal Op represents the deviation "$-C_1$" because the operational signal Op is obtained by subtracting the actual position from the target position as in the above mentioned case. The shift signal supplied from the subtractor 32-1 represents "$-a-(-C_1)$" corresponding to "$-\beta_1$". The value of "$-\beta_1$" becomes negative because an amount of "C" is smaller than that of "a". However, "$\beta_1$" in FIG. 9 represents a difference between two points, so that is indicated as "$a-C_1$" rather than "$C_1-a$". In response to the first coincidence detection signal, the latch circuit 32-2 latches the shift signal "$\beta_1$" as the latched signal that is supplied to the adder 32-5. The adder 32-5 adds the shift signal "$\beta_1$" to the accumulated signal. The register 32-6 stores the accumulated signal representing "$-a$" at that moment, so that the compensation signal to be stored in the register is equal to "$-a-\beta_1$". The compensation signal "$-a-\beta_1$" is supplied from the register 32-6 to the adder 31 at a time instance $t_2$. Accordingly, the modified target position is decreased by "$\beta_1$".

The operational signal Op obtained at a time instance $t_3$ represents the deviation "$-C_2$" and the shift signal supplied from the subtractor 32-1 is represented as "$-\beta_2$". Thus the compensation signal "$-a-\beta_1-\beta_2$" is supplied from the register 32-6 to the adder 31 at a time instance $t_4$ and the modified target position is decreased by "$\beta_2$". The shift signal supplied at a time instance $t_5$ is represented as "$-\beta_3$" and the compensation signal "$-a-\beta_1-\beta_2-\beta_3$" is supplied from the register 32-6 to the adder 31 at a time instance $t_6$. Consequently, the modified target position is further decreased by "$\beta_3$". This continues until the deviation between the modified target position and the actual position of the long-side copper plate 13 becomes equal.

As apparent from the above, the offset value is one of the outstanding features of the present invention. The amount of the offset value in practice depends on the speed (referred to as a follow speed) at which the actual position of the long-side copper plate 13 follows the modified target position. The offset value may theoretically be any suitable value as long as the absolute value (magnitude) of the offset is larger than the deviation between the actual and target position at a certain time instance when the actual position of the long-side copper plate 13 is not affected by the short-side copper plate 14. Such deviation is referred to as 25 a follow distance below. The offset value can accordingly be a value that satisfies the condition, |"$-a$"| is larger than the follow distance. It is, however, preferable that the absolute value of the offset is sufficiently larger than the follow distance to yield a desired result in a reasonable time. The reason is that the upper apex (i.e., the target open position) of the waveform is shifted by an amount equal to the difference between the absolute value of the offset and the follow distance. The absolute value of the offset is about 3.5 times larger than the follow distance in the above embodiment. Of course, it is also possible to define larger or smaller offset value depending on the follow distance. The follow distance becomes large as the follow speed becomes slow while immediate response causes the follow distance to be small.

It should be understood that the present invention is not limited to the particular embodiment shown and described above, and various changes and modifications may be made without departing from the spirit and scope of the appended claims.

What is claimed is:

1. A control device for controlling horizontal oscillation on a mold into which molten metal is poured in a continuous casting machine, said mold having a mold frame; two long-side plates opposed with each other; and two short-side plates extending orthogonal to said long-side plates, each of said long-side plates being movably attached to said mold frame such that they can move horizontally through hydraulic cylinders and each of said hydraulic cylinders having a piston rod, wherein said control device comprising:

position detecting means attached to said piston rod for detecting an actual position of said long-side plates to produce an actual horizontal position signal representing the detected actual position of said long-side plates;

open-close control means connected to said position detecting means, supplied with a target horizontal position command, and given to a predetermined offset value, for producing a control signal by using said target horizontal position command, said actual horizontal position signal, and said predetermined offset value, said target horizontal position command representing a target horizontal position of said long-side plates and said target horizontal position varies from a target close position up to a target open position indicated as a function of time, said control signal indicating a deviation between said target horizontal position and said detected actual horizontal position, said open-close control means making said deviation to be equal to said predetermined offset value when said target horizontal position is equal to said target close position; and driving means, connected to said open-close control means and said hydraulic cylinders, for driving said hydraulic cylinders according to said control signal.

2. A control device as claimed in claim 1, wherein said open-close control means comprises:

target position modifying means, responsive to said target horizontal position command, an operational signal representing said deviation, and said predetermined offset value, for modifying said target horizontal position into a modified target position such that said deviation is made to be equal to said predetermined offset value when said target horizontal position is equal to said target close position, said target position modifying means producing a modified target position command indicating said modified target position;

subtraction means, connected to said target position modifying means and said position detecting means, for subtracting said actual horizontal position signal from said modified target position command to produce said operational signal; and adjusting means, connected to said subtraction means and said driving means, for multiplying said operational signal by a predetermined gain constant to supply said control signal to said driving means.

3. A control device as claimed in claim 2, wherein said offset value is negative and has a magnitude that is larger than the deviation between said actual horizontal position and said target horizontal position at a time instance when said actual horizontal position is not affected by said short-side plates.

4. A control device as claimed in claim 2, wherein said target position modifying means comprises:

reference position compensation means, responsive to said target horizontal position command, said operational signal, and said predetermined offset value, for compensating said target close position by comparing said predetermined offset value with said deviation and by accumulating comparison results, said reference position compensation means producing a compensation signal with which said deviation becomes equal to said offset value when said target horizontal position comes up to said target close position; and adding means, connected to said reference position compensation means, for adding said compensation signal to said target horizontal position command to produce said modified target position command.

5. A control device as claimed in claim 4, wherein said reference position compensation means comprises:

comparing means, connected to said subtraction means, supplied with said offset value and said target horizontal position command, and given with said target close position, for comparing said offset value with said deviation to produce said comparison results at every timing when said target horizontal position comes up to said target close position; and accumulating means, connected to said comparing means and supplied with said target horizontal position command and given with said target open position, for accumulating said comparison results at every timing when said target horizontal position comes up to said target open position, said accumulating means producing said accumulated signal as said compensation signal.

6. A control device as claimed in claim 5, wherein said comparing means comprises:

subtracting means, connected to said subtraction means and supplied with said offset value, for subtracting said operational signal from said offset value to produce a shift signal indicating a shift amount by which said modified target position is to be shifted;

first coincidence detecting means, supplied with said target horizontal position command and given with said target close position, for detecting coincidence between said target horizontal position and said target close position to produce a first coincidence detection signal on detecting the coincidence; and latch means, connected to said subtracting means and said first coincidence detecting means, for latching said shift signal as a latched signal in response to said first coincidence detection signal to produce said latched signal as one of said comparison results.

7. A control device as claimed in claim 5, said accumulating means comprises:

an adder, connected to said comparing means, adding said one of the comparison results to said accumulated signal to produce an addition signal;

second coincidence detecting means, supplied with said target horizontal position command and given with said target open position, for detecting coincidence between said target horizontal position and said target open position to produce a second coincidence detection signal on detecting the coincidence; and a register, connected to said adder and said second coincidence detecting means, for storing said addition signal as a stored signal in response to said second coincidence detection signal to produce said stored signal as said accumulated signal.

* * * * *

UNITED STATES PATENT AND TRADEMARK OFFICE

CERTIFICATE OF CORRECTION

PATENT NO. : 5,350,005

DATED : September 27, 1994

INVENTOR(S) : Kenichi SORIMACHI et al

It is certified that error appears in the above-indentified patent and that said Letters Patent is hereby corrected as shown below:

In Column 10, line 9, after "A", insert -- continuous casting machine which includes a --.

In Column 10, line 10, delete "in a".

In Column 10, line 11, delete "continuous casting machine".

In Column 10, line 25, delete "supplied with" and insert -- means for supplying --.

In Column 10, line 26, delete "given to" and insert -- means for providing --.

In Column 10, line 27, delete "for" and insert -- said control means --.

In Column 12, line 23, before "said", insert -- wherein --.

In Column 12, line 25, before "adding", insert -- for --.

Signed and Sealed this

Sixth Day of December, 1994

*Attest:*

Bruce Lehman

BRUCE LEHMAN

*Attesting Officer*

*Commissioner of Patents and Trademarks*